US011135558B2

(12) United States Patent
Bae

(10) Patent No.: US 11,135,558 B2
(45) Date of Patent: Oct. 5, 2021

(54) OIL-WATER-VACUUM-MIXED FUEL PRODUCTION APPARATUS

(71) Applicant: Seo Jun Bae, Gimje (KR)

(72) Inventor: Seo Jun Bae, Gimje (KR)

( * ) Notice: Subject to any disclaimer, the term of this patent is extended or adjusted under 35 U.S.C. 154(b) by 398 days.

(21) Appl. No.: 16/327,585

(22) PCT Filed: Aug. 22, 2017

(86) PCT No.: PCT/KR2017/009130

§ 371 (c)(1),
(2) Date: Feb. 22, 2019

(87) PCT Pub. No.: WO2018/038498

PCT Pub. Date: Mar. 1, 2018

(65) Prior Publication Data

US 2019/0275480 A1 Sep. 12, 2019

(30) Foreign Application Priority Data

Aug. 22, 2016 (KR) ..... 10-2016-0105911

(51) Int. Cl.

| | |
|---|---|
| ***B01F 7/00*** | (2006.01) |
| ***B01F 7/18*** | (2006.01) |
| ***B01F 3/08*** | (2006.01) |
| ***B01F 15/00*** | (2006.01) |
| ***B01F 15/02*** | (2006.01) |

(52) U.S. Cl.

CPC ..... *B01F 7/18* (2013.01); *B01F 3/0807* (2013.01); *B01F 15/00* (2013.01); *B01F 15/00155* (2013.01); *B01F 15/02* (2013.01); *B01F 15/026* (2013.01); *B01F 2215/0088* (2013.01)

(58) Field of Classification Search

CPC .. B01F 7/18; B01F 2215/0088; B01F 3/0807; B01F 15/00; B01F 7/00633; B01F 7/00958; B01F 7/00625; B01F 7/00925; B01F 7/30; B01F 7/1665; B01F 15/00155; B01F 15/02; B01F 15/026

See application file for complete search history.

(56) References Cited

U.S. PATENT DOCUMENTS 2,548,340 A * 4/1951 Bower ..... B28B 17/023 366/11
4,871,259 A * 10/1989 Harada ..... B29B 7/7495 366/85
5,782,556 A * 7/1998 Chu ..... F23K 5/12 366/155.1

FOREIGN PATENT DOCUMENTS

KR 10-0450328 B1 9/2004
KR 10-0893760 B1 4/2009
KR 10-2014-0071721 A 6/2014

(Continued)

*Primary Examiner* — Anshu Bhatia

(74) *Attorney, Agent, or Firm* — Patent Office of Dr. Chung Park

(57) ABSTRACT

The present invention relates to an apparatus for producing a fuel made by mixing water with oil in a vacuum state. The apparatus includes: a vacuum tank adapted to seal an internal space thereof to allow the internal space to be maintained to a vacuum state; a vacuum pump located on one side of the vacuum tank to suck the air from the interior of the vacuum tank, so that the vacuum tank is kept in the vacuum state; a stirring vessel located inside the vacuum tank in such a manner as to communicate with the vacuum tank through a bypass pipe, the water and oil being supplied thereto; and stirrers rotating by the drive of motors to stirringly mix the water with the oil.

5 Claims, 7 Drawing Sheets

(56) References Cited

FOREIGN PATENT DOCUMENTS

| | | | |
|---|---|---|---|
| KR | 10-2014-0131235 | A | 11/2014 |
| KR | 10-1551742 | B1 | 9/2015 |

* cited by examiner

OIL-WATER-VACUUM-MIXED FUEL PRODUCTION APPARATUS

TECHNICAL FIELD

The present invention relates to an apparatus for producing a fuel made by mixing water with oil in a vacuum state and, more particularly, to an apparatus for producing a fuel made by mixing water with oil in a vacuum state that is capable of producing the fuel with an improved combustion efficiency by mixing the water with the oil in the vacuum state where a pressure is reduced, without using any emulsifying agent, such as a surfactant, in the mixing process.

BACKGROUND ART

Generally, a combustion device makes use of heat generated during combustion of a fuel, and if the fuel is incompletely burnt, a combustion rate is lowered, and also, pollutants like carbon monoxide are exhausted.

To reduce such pollutants, recently, a lot of attention has been given to an emulsion fuel so that pollution prevention and energy saving are achieved. In this case, water and an emulsifying agent are added to a fuel such as heavy oil, kerosene, and bunker oil C, and accordingly, the emulsified fuel is burnt.

The emulsifying agent serves to delay separation of water from oil. Through a specific gravity difference between the water and the oil, in this case, water particles are exploded to fine particles, and by means of the explosion of the water particles, oil particles are micronized and exploded, so that combustion becomes accelerated, thereby increasing a combustion efficiency and reducing an amount of nitrogen oxide generated.

In spite of the addition of the emulsifying agent, however, the water is not evenly mixed with the oil, and also, a lot of time is required to mix them. Further, the emulsifying agent is produced from petroleum, which causes crude oil to be unavoidably used in a manufacturing process thereof, and accordingly, lots of byproducts unnecessary or byproducts giving harm to environments may be generated in a production process of the emulsifying agent.

So as to solve the above-mentioned problems, accordingly, a device for mixing water with oil through an ultrasonic transducer has been proposed in Korean Patent No. 10-0352091, wherein the ultrasonic transducer includes a connector disposed on the underside thereof to transfer ultrasonic vibrations, a vibrator disposed on the underside of the connector, an introduction part disposed between the connector and the vibrator, and an oil introduction pipe and a water introduction pipe connected to each other on one side and the other side of the outer periphery of the introduction part to discharge oil and water to the center of an inner lower portion of the vibrator.

According to the conventional device as mentioned above, however, given amounts of water and oil are supplied to a storage tank, and in this state, the water and oil are mixed directly by means of the ultrasonic transducer. In this case, since the water and oil are just supplied and mixed in a state where their cohesive force is strong, a lot of time is required so as to allow the water to be sufficiently mixed with the oil, and further, the water undesirably becomes rapidly separated from the oil.

DISCLOSURE

Technical Problem

Accordingly, the present invention has been made in view of the above-mentioned problems occurring in the prior art, and it is an object of the present invention to provide an apparatus for producing a fuel made by mixing water with oil in a vacuum state that is capable of mixing the water with the oil at a high speed in the vacuum state, so that since there is no specific gravity difference between the water and the oil, separation of the water from the oil can be delayed, and large amounts of water and oil can be mixed with each other within a short time, thereby greatly improving productivity thereof.

It is another object of the present invention to provide an apparatus for producing a fuel made by mixing water with oil in a vacuum state that is capable of providing a bypass pipe through which a vacuum tank and a stirring vessel communicate with each other, so that if a vacuum pump operates, air in the stirring vessel as well as the air in the vacuum tank is sucked to the vacuum pump through the bypass pipe.

Technical Solution

To accomplish the above-mentioned objects, according to the present invention, there is provided an apparatus for producing a fuel made by mixing water with oil in a vacuum state, the apparatus including: a vacuum tank adapted to seal an internal space thereof to allow the internal space to be maintained to a vacuum state; a vacuum pump located on one side of the vacuum tank to suck the air from the interior of the vacuum tank, so that the vacuum tank is kept in the vacuum state; a stirring vessel located inside the vacuum tank in such a manner as to communicate with the vacuum tank through a bypass pipe, the water and oil being supplied thereto; and stirrers rotating by the drive of motors to stirringly mix the water with the oil.

According to the present invention, desirably, the stirring vessel has a structure in which a plurality of cylindrical containers are bonded to each other, the cylindrical containers having cut portions formed by cutting side peripheries thereof in such a manner as to be face-contacted with each other and thus bonded to each other According to the present invention, desirably, the stirring vessel is connected to a water supply pipe on which an electronic water supply valve is disposed and to an oil supply pipe on which an electronic oil supply valve is disposed, and the water supply pipe and the oil supply pipe have metering pumps disposed correspondingly on one end thereof.

According to the present invention, desirably, the stirring vessel has a level sensor disposed on one side of top thereof to sense levels of the water and oil supplied to the interior thereof, so that opening and closing of the electronic water supply valve and the electronic oil supply valve are controlled according to level sensing signals outputted from the level sensor.

According to the present invention, desirably, each stirrer includes a rotating shaft rotating through the drive of the corresponding motor, a plurality of stirring wings rotatably coupled to one side of the lower periphery of the rotating shaft, and a plurality of blades coupled to the rotating shaft in such a manner as to be spaced apart from the stirring wings to allow particles to be ultra-micronized.

According to the present invention, desirably, the stirrers are located at eccentric positions from the center of the stirring vessel by given distances.

According to the present invention, desirably, the stirrers mix the water with the oil through the stirring wings and the blades rotating at a rotating speed of 10,000 to 25,000 rpm and generate cavitation through a collision plate disposed on the inner lower portion of the stirring vessel.

Advantageous Effects

According to the present invention, the apparatus for producing a fuel made by mixing water with oil in a vacuum state is capable of mixing the water with the oil at a high speed in the vacuum state, so that since there is no specific gravity difference between the water and the oil, separation of the water from the oil can be delayed, and large amounts of water and oil can be mixed with each other within a short time, thereby greatly improving productivity thereof.

In addition, the apparatus for producing a fuel made by mixing water with oil in a vacuum state is capable of providing the bypass pipe through which the vacuum tank and the stirring vessel communicate with each other, so that if the vacuum pump operates, air in the stirring vessel as well as the air in the vacuum tank is sucked to the vacuum pump through the bypass pipe.

BRIEF DESCRIPTION OF DRAWINGS

FIGS. 4A and 4B are sectional views showing fluid flows according to installation positions of the stirrers in the apparatus according to the present invention, wherein FIG. 4A shows the stirrer is installed eccentrically inside the stirring vessel and FIG. 4B shows the stirrer is installed at the center of the stirring vessel.

EXPLANATIONS ON REFERENCE NUMERALS IN THE DRAWINGS

Figure 1:
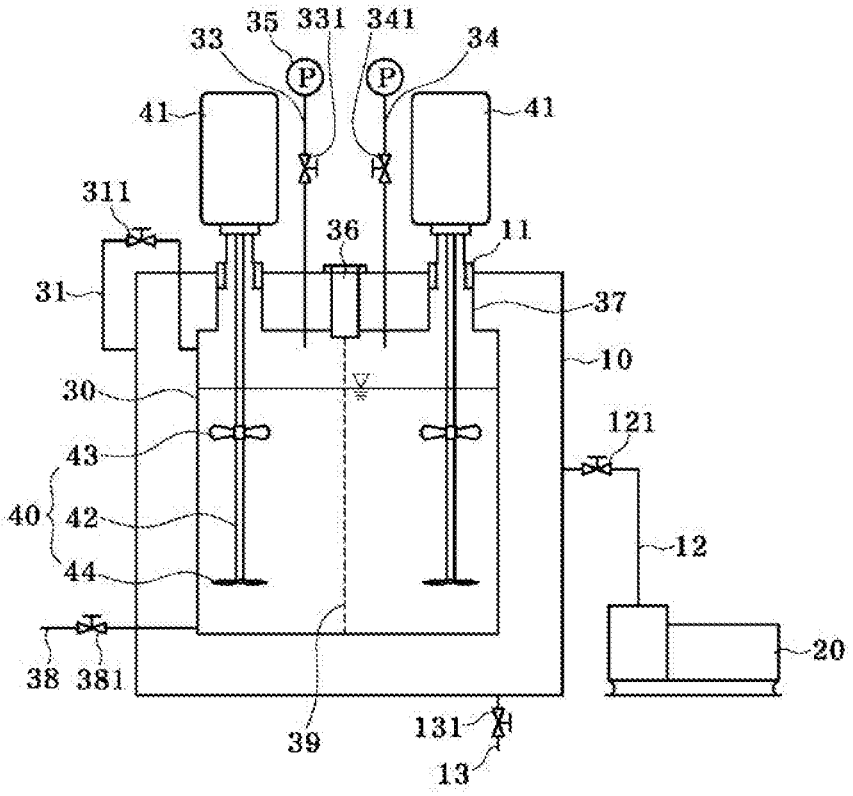
FIG. 1 is a side view showing an apparatus for producing a fuel made by mixing water with oil in a vacuum state according to an embodiment of the present invention.

10: vacuum tank
11: housing
12: suction pipe
121: electronic check valve
13: drain pipe
131: valve
20: vacuum pump
30: stirring vessel
31: bypass pipe
311: opening and closing valve
32: cutting portion
33: water supply pipe
331: electronic water supply valve
34: oil supply pipe
341: electronic oil supply valve
35: metering pump
36: level sensor
37: coupling portion
381: fuel discharge pipe
381: electronic discharge valve
39: bonding portion
40: stirrer
41: motor
42: rotating shaft
43: stirring wing
44: blade
45: collision plate

BEST MODE FOR INVENTION

All terms used herein, including technical or scientific terms, unless otherwise defined, have the same meanings which are typically understood by those having ordinary skill in the art. The terms, such as ones defined in common dictionaries, should be interpreted as having the same meanings as terms in the context of pertinent technology, and should not be interpreted as having ideal or excessively formal meanings unless clearly defined in the specification.

The present invention may be modified in various ways and may have several exemplary embodiments. Specific exemplary embodiments of the present invention are illustrated in the drawings and described in detail in the detailed description. However, this does not limit the invention within specific embodiments and it should be understood that the invention covers all the modifications, equivalents, and replacements within the idea and technical scope of the invention.

Before the present invention is disclosed with reference to the attached drawings, if it is determined that the detailed explanation on the well known technology related to the present invention makes the scope of the present invention not clear, the explanation will be avoided for the brevity of the description.

Hereinafter, an explanation on an apparatus for producing a fuel made by mixing water with oil in a vacuum state according to the present invention will be in detail given with reference to the attached drawing.

Figure 2:
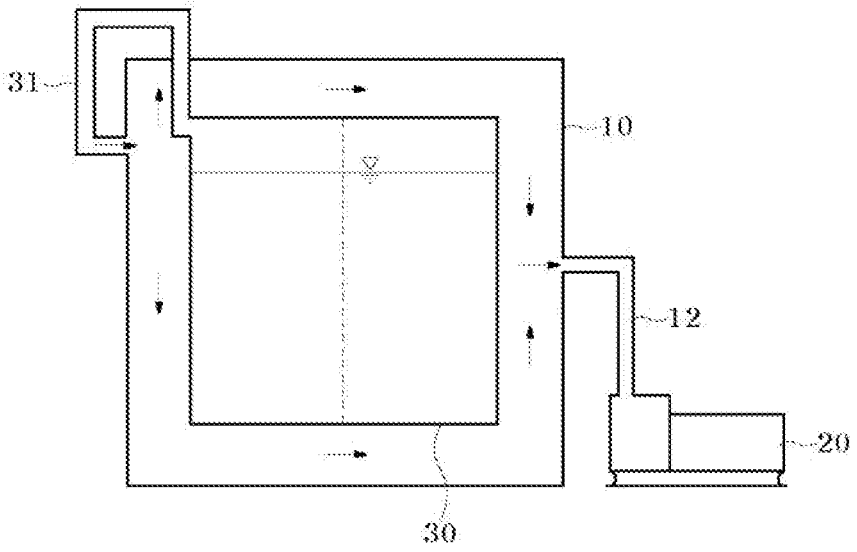
FIG. 2 is a sectional view showing a vacuum tank and a stirring vessel in the apparatus according to the present invention.

FIG. 1 is a side view showing an apparatus for producing a fuel made by mixing water with oil in a vacuum state according to an embodiment of the present invention, and FIG. 2 is a sectional view showing a vacuum tank and a stirring vessel in the apparatus according to the present invention.

The present invention relates to an apparatus for producing a fuel made by mixing water with oil in a vacuum state, and the apparatus, which is capable of mixing the water with the oil in the vacuum state where a pressure is reduced, without using any emulsifying agent, such as a surfactant, in the mixing process, largely includes a vacuum tank 10, a vacuum pump 20, a stirring vessel 30, and stirrers 40.

The vacuum tank 10 serves to seal an internal space thereof to allow the internal space to be maintained to a vacuum state, to make up for a pressure of the vacuum pump 20, and to shorten a given time required for high vacuum. The vacuum tank 10 has a drain pipe 13 disposed on one side of the underside thereof and a valve 131 mounted on the drain pipe 13.

The high vacuum (more than $10^{-3}$ torr) is in a state where gas in the stirring vessel 30 is exhausted to produce a high level pressure-reduced state, so that since a specific gravity difference and interfacial tension between water and oil are decreased, load applied to the apparatus is reduced and a stirring efficiency is increased.

If levels of water and oil are raised, that is, their volume is decreased and their vacuum pressure is lowered, so that their stirring efficiency becomes low. Contrarily, if levels of water and oil are lowered, their volume is increased and their vacuum pressure is raised, so that their stirring efficiency becomes high, but amounts of the water and oil are small to make work's efficiency bad.

According to the present invention, therefore, the apparatus has a double structure in which the stirring vessel 30 is accommodated in the interior of the vacuum tank 10, thereby sufficiently ensuring the space of the vacuum tank 10 and greatly improving vacuum efficiency and productivity, and if an electronic check valve 121 as will be discussed later is open, the vacuum tank 10 changes into a high vacuum state within several seconds, thereby providing a state good for the stirring operation.

The vacuum pump 20 is located on one side of the vacuum tank 10 to suck the air from the interior of the vacuum tank 10, so that the vacuum tank 10 can be kept in the vacuum state.

The vacuum pump 20 is connected to one end of a suction pipe 12 connected to one side of the outside of the vacuum tank 10, and the air in the vacuum tank 10 is sucked only to the vacuum pump 20 through the electronic check valve 121 disposed on one side of the suction pipe 12.

The stirring vessel 30, to which the water and oil are supplied, is located inside the vacuum tank 10 in such a manner as to communicate with the vacuum tank 10 through a bypass pipe 31.

An opening and closing valve 311 is disposed on one side of the bypass pipe 31 to open and close the bypass pipe 31 so that air flows along the bypass pipe 31.

If the vacuum pump 20 operates, air in the stirring vessel 30 as well as the air in the vacuum tank 10 is also sucked to the vacuum pump 20 through the bypass pipe 31, so that the vacuum tank 10 can reach a given vacuum pressure within a short time.

The stirring vessel 30 has a fuel discharge pipe 38 connected to one side of the lower portion thereof to discharge the fuel made by mixing the water with the oil, and an electronic discharge valve 381 is disposed on one side of the fuel discharge pipe 38.

The stirring vessel 30 has coupling portions 37 protruding upwardly from the top thereof in a state of being accommodated inside the vacuum tank 10 in such a manner as to be coupled to housings 11 coupled to top of the vacuum tank 10, and accordingly, the stirring vessel 30 becomes fixed in position inside the vacuum tank 10.

The stirring vessel 30 has a structure in which a plurality of cylindrical containers are bonded to each other, and in a state where cut portions 32 formed by cutting the side peripheries of the cylindrical containers are face-contacted with each other, that is, the cylindrical containers are bonded to each other.

If the stirrers 40 rotate by the drive of motors 41 as will be discussed later, accordingly, the water is mixed with the oil by means of a plurality of stirring wings 43 and blades 44 as will be discussed later to produce vortexes rapidly, and at this time, the water and oil are stirredly mixed with each other in a bonding portion 39 of the stirring vessel 30 through a centrifugal force.

The stirring vessel 30 is connected to a water supply pipe 33 on which an electronic water supply valve 331 is disposed and to an oil supply pipe 34 on which an electronic oil supply valve 341 is disposed, and metering pumps 35 are disposed correspondingly on one end of the water supply pipe 33 and one end of the oil supply pipe 34.

The stirring vessel 30 has a level sensor 36 disposed on one side of top thereof to sense levels of water and oil supplied to the interior thereof, so that opening and closing of the electronic water supply valve 331 and the electronic oil supply valve 341 are controlled according to level sensing signals outputted from the level sensor 36.

In detail, the metering pumps 35 operate to supply fixed amounts of water and oil to the stirring vessel 30, and the electronic water supply valve 331 and the electronic oil supply valve 341 are closed according to the level sensing signals outputted from the level sensor 36, while the electronic check valve 121 is being open, so that the stirring vessel 30 changes into a high vacuum state through a strong suction force of the vacuum tank 10 in the high vacuum state.

Figure 3:
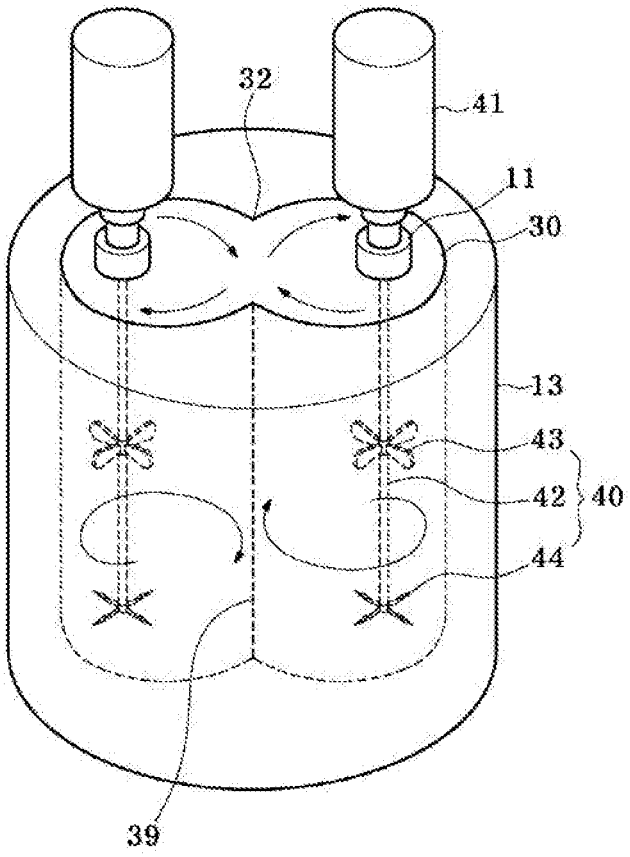
FIG. 3 is a perspective view showing installation states of stirrers in the apparatus according to the present invention.
Figure 4A:
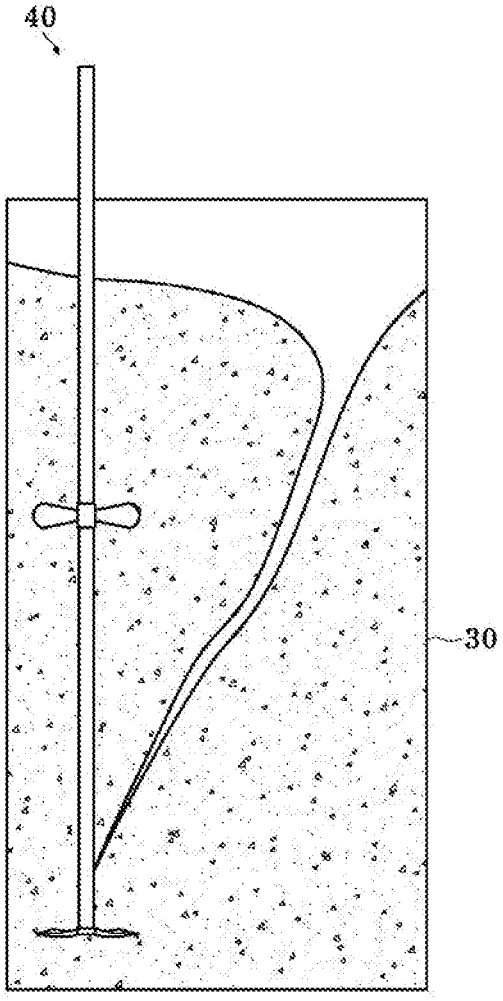
Figure 4B:
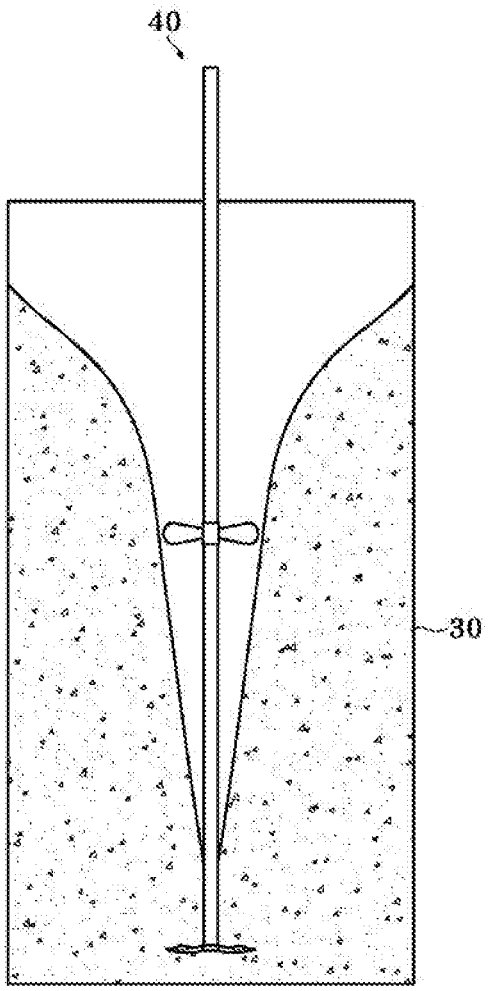

FIG. 3 is a perspective view showing installation states of stirrers in the apparatus according to the present invention, and FIGS. 4A and 4B are sectional views showing fluid flows according to installation positions of the stirrers in the apparatus according to the present invention, wherein FIG. 4A shows the stirrer is installed eccentrically inside the stirring vessel and FIG. 4B shows the stirrer is installed at the center of the stirring vessel.

The stirrers 40 rotate by the drive of the motors 41 to stir the water and oil in the stirring vessel 30.

Each stirrer 40 includes a rotating shaft 42 rotating through the drive of the corresponding motor 41, the plurality of stirring wings 43 rotatably coupled to one side of the lower periphery of the rotating shaft 42, and the plurality of blades 44 coupled to the rotating shaft 42 in such a manner as to be spaced apart from the stirring wings 43 to allow particles to be ultra-micronized.

If the rotating shafts 42 rotate to a high speed through the drive of the motors 42, accordingly, the water and oil are first emulsified slightly by means of shear forces of the blades 44, and next, they rotate more rapidly to form vortexes through pressurizing forces of the stirring wings 43. At this time, the water and oil are met in the bonding portion 39 of the stirring vessel 30 and are then mixed with each other to produce a fuel having a color of milk.

Particularly, the number of revolutions per minute of each motor 42 operating to mix the water with the oil is 15,000 rpm in case where the oil is kerosene, it is 18,000 rpm in case where the oil is diesel oil, and it is in a range of 20,000 to 5,000 rpm in case where the oil is bunker oil C.

The rotating speeds of the motors 42 are controlled according to the viscosity and specific gravity of the water and oil mixed, thereby increasing and decreasing the stirring efficiency.

The produced fuel is continuously kept in an emulsified state, without any separation of the water from the oil, in the high vacuum state always maintained. So as to supply the fuel, the electronic check valve 121 of the suction pipe 12 is closed, and in a state where the stirring vessel 30 changes into a low vacuum state, the electronic discharge valve 38 is open.

Desirably, the stirrers 40 are located at eccentric positions from the center of the stirring vessel 30 by given distances.

If the rotating shaft 42 of the stirrer 40 is located close to the inner peripheral wall of the stirring vessel 30, as shown in FIG. 4A, the flow of the fluid is fast at the side of the blades 44 and is slow in the bonding portion 39 of the stirring vessel 30, so that the centrifugal force is concentrated on the bonding portion 39 of the stirring vessel 30 and a vortex and a horn-shaped hole on the top of the fluid become small, thereby increasing tangential shear forces of the blades 44 and the stirring efficiency of the stirrer 40.

If the rotating shaft 42 of the stirrer 40 is located at the center of the stirring vessel 30, as shown in FIG. 4B, a vortex is evenly distributed to 360°. As the rotating speed of the rotating shaft 42 is fast, accordingly, a vortex on the center of the top of the fluid becomes large, and a horn-shaped hole is formed up to the blades 44, thereby decreasing the shear forces of the blades 44 applied to the fluid.

Figure 5:
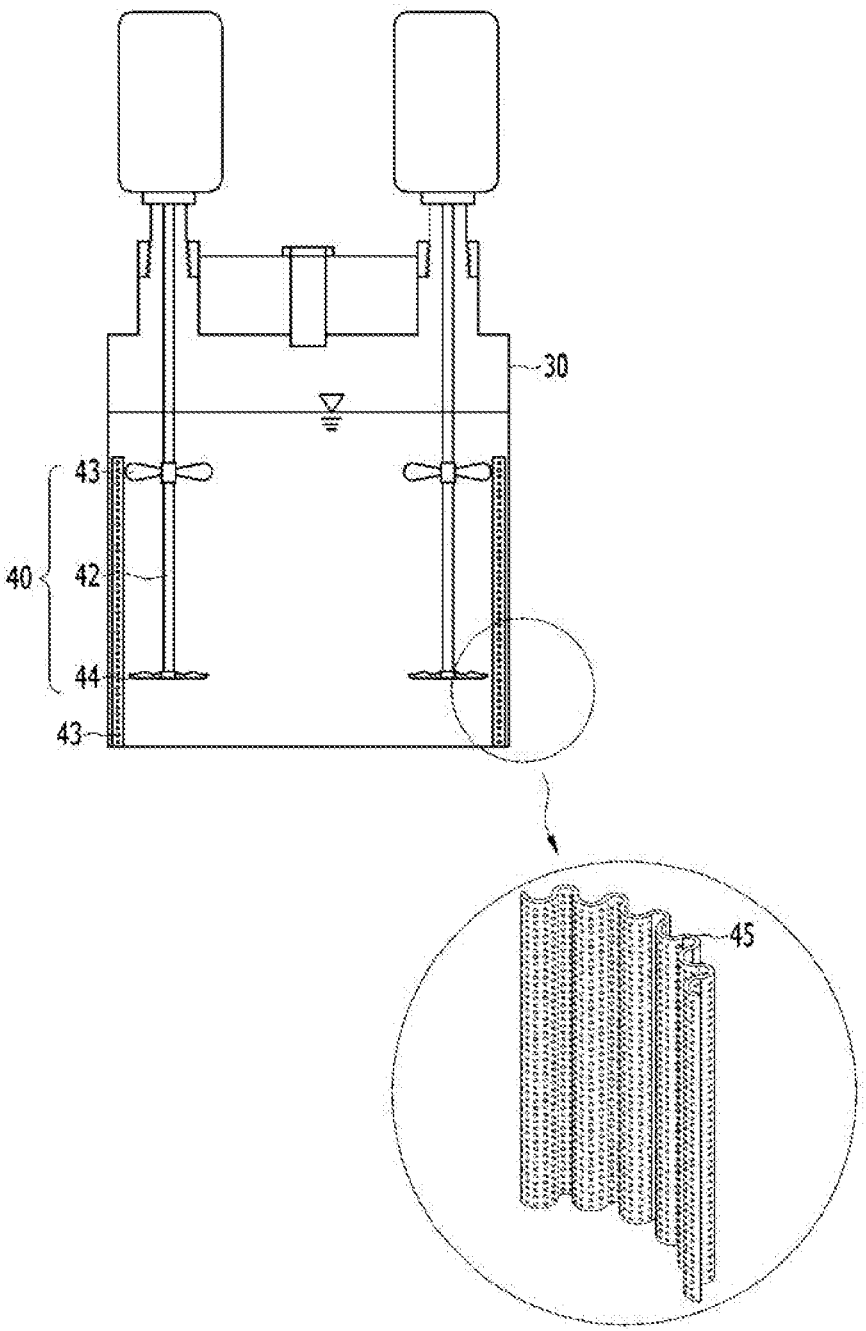
FIG. 5 is a sectional view showing a state where a collision plate is disposed inside the stirring vessel in the apparatus according to the present invention.

FIG. 5 is a sectional view showing a state where a collision plate is disposed inside the stirring vessel in the apparatus according to the present invention.

The stirrers 40 serve to mix the water with the oil through the stirring wings 43 and the blades 44 rotating at the rotating speed of 10,000 to 25,000 rpm and also to generate cavitation from a collision plate 45 disposed on the inner lower portion of the stirring vessel 30.

The collision plate 45 is located close to the inner lower peripheral wall of the stirring vessel 30 and is curvedly shaped to have a plurality of punched holes formed thereon. At this time, as shown in an enlarged portion of FIG. 5, the collision plate 45 is desirably curvedly formed to have a plurality of corrugations.

In detail, vortexes are formed on the left and right sides of the blades 44 rotating at the ultra speed of 10,000 to 25,000 rpm to allow the water and oil to collide against the collision plate 45. The water and oil colliding to a high speed against the collision plate 45 are introduced into the punched holes of the collision plate 45. Especially, low pressures are formed on the outer peripheries of the punched holes to thus generate cavitation, and accordingly, the water and oil become ultra fine particles.

Figure 6:
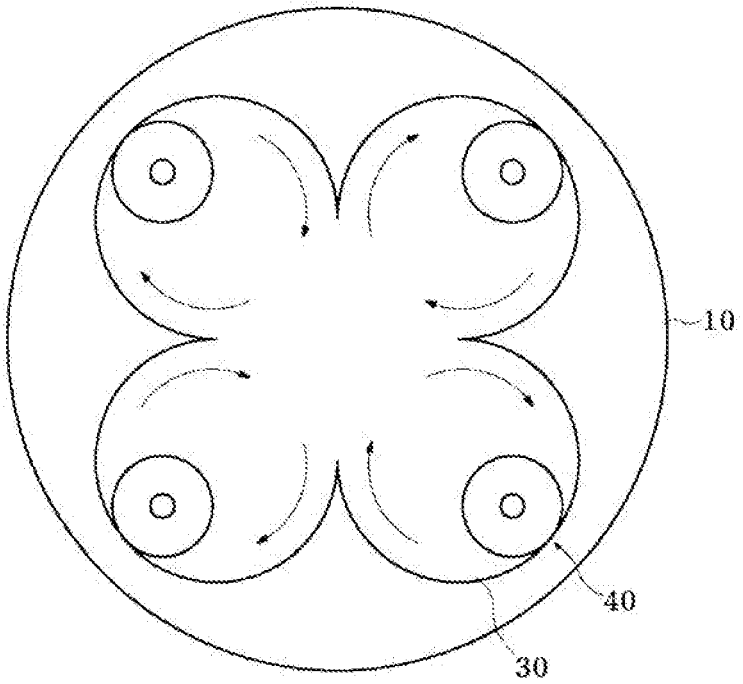
FIG. 6 is a plan view showing an apparatus for producing a fuel made by mixing water with oil in a vacuum state according to another embodiment of the present invention.

FIG. 6 is a plan view showing an apparatus for producing a fuel made by mixing water with oil in a vacuum state according to another embodiment of the present invention, wherein a plurality of stirring vessels and stirrers are disposed according to an amount of fuel manufactured thereby.

Even not shown in the drawings, on the other hand, a controller is included in the apparatus of the present invention to control operations of the vacuum pump, the stirrers, and the various valves.

The controller is electrically connected to the level sensor to receive the measured signals from the level sensor and thus generates control signals according to the received signals.

For example, the electronic water supply valve and the electronic oil supply valve, which receive the valve control signals generated from the controller, are controlled closed, and the electronic check valve disposed on the suction pipe is controlled open, so that the interior of the stirring vessel changes into the high vacuum state.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

The invention claimed is:

1. An apparatus for producing a fuel made by mixing water with oil in a vacuum state, the apparatus comprising:

a vacuum tank adapted to seal an internal space thereof to allow the internal space to be maintained to the vacuum state;

a vacuum pump located on one side of the vacuum tank to suck air from an interior of the vacuum tank, so that the vacuum tank is kept in the vacuum state;

a stirring vessel located inside the vacuum tank in such a manner as to communicate with the vacuum tank through a bypass pipe, the water and oil being supplied thereto; and a plurality of stirrers rotated by the drive of motors to stirringly mix the water with the oil, wherein the stirring vessel has a structure in which a plurality of cylindrical containers are bonded to each other, the plurality of cylindrical containers having cut portions formed by cutting side peripheries thereof in such a manner as to be face-contacted with each other and thus bonded to each other to form a bonding portion, and the plurality of cylindrical containers are connected correspondingly to a water supply pipe on which an electronic water supply valve is disposed and to an oil supply pipe on which an electronic oil supply valve is disposed, the water supply pipe and the oil supply pipe having metering pumps disposed correspondingly on one end thereof, whereby after an interior of the stirring vessel reaches a given vacuum pressure through the bypass pipe, the plurality of stirrers operate to allow the water and oil to be met and stirredly mixed at the bonding portion of the stirring vessel.

2. The apparatus according to claim 1, wherein the stirring vessel has a level sensor disposed on one side of a top thereof to sense levels of the water and oil supplied to the interior of the stirring vessel, so that opening and closing of the electronic water supply valve and the electronic oil supply valve are controlled according to level sensing signals outputted from the level sensor.

3. The apparatus according to claim 1, wherein each stirrer comprises a rotating shaft rotating through the drive of the corresponding motor, a plurality of stirring wings rotatably coupled to one side of the lower periphery of the rotating shaft, and a plurality of blades coupled to the rotating shaft in such a manner as to be spaced apart from the stirring wings to allow particles to be ultra-micronized.

4. The apparatus according to claim 3, wherein the plurality of stirrers mix the water with the oil through the plurality of stirring wings and the plurality of blades rotating at a rotating speed of 10,000 to 25,000 rpm and generate cavitation through a collision plate disposed on an inner lower portion of the stirring vessel.

5. The apparatus according to claim 1, wherein the plurality of stirrers are located at eccentric positions from a center of the stirring vessel by given distances.

* * * * *